US005626495A

United States Patent [19]

Drewnicki

[11] Patent Number: 5,626,495

[45] Date of Patent: May 6, 1997

[54] SCREWLESS CONNECTOR

[75] Inventor: Richard Drewnicki, Leicestershire, United Kingdom

[73] Assignee: Rutland Gilts Limited, London, England

[21] Appl. No.: 227,143

[22] Filed: Apr. 13, 1994

[51] Int. Cl.[6] ..... H01R 33/92

[52] U.S. Cl. ..... 439/651; 439/222

[58] Field of Search ..... 439/217, 218, 439/221, 222, 223, 650, 651, 655, 695, 696, 701, 595

[56] References Cited

U.S. PATENT DOCUMENTS

| | | | |
|---|---|---|---|
| 1,979,958 | 11/1934 | Clark | 439/651 |
| 2,988,617 | 6/1961 | Graziosi | 439/651 |
| 4,787,857 | 11/1988 | Kretchmar et al. | 439/651 |
| 4,884,980 | 12/1989 | Bensing et al. | 439/695 |
| 5,154,642 | 10/1992 | Chung-Yin | 439/695 |
| 5,190,476 | 3/1993 | Chaillot | 439/595 |
| 5,238,411 | 8/1993 | Jinno et al. | 439/595 |

FOREIGN PATENT DOCUMENTS

| | | | |
|---|---|---|---|
| 788746 | 3/1956 | United Kingdom | 439/222 |
| 2042285 | 9/1980 | United Kingdom . | |
| 2077052 | 12/1981 | United Kingdom . | |
| 2112593 | 7/1983 | United Kingdom . | |
| 2185645 | 7/1987 | United Kingdom . | |
| WO9311588 | 6/1993 | WIPO | 439/217 |

*Primary Examiner*—David L. Pirlot
*Assistant Examiner*—Brian J. Biggi
*Attorney, Agent, or Firm*—Lowe, Price, LeBlanc & Becker

[57] ABSTRACT

An electrical connector having a hollow electrically insulating body having opposed ends. A set of male electrical contact members is on one end of the body. First and second body part together define the body. One of the body parts defines the one end of the body and its hollow interior. The other of the body parts defines the other end of the body. A recess in the one body part communicates with the hollow interior of the body, and receives the other body part. Means extending from the other body part into the hollow interior serves in trapping thus locating electrical conductor means associated with the male electrical contact members and as part of members frictionally interengaging to resist disassembly of the body.

18 Claims, 3 Drawing Sheets

SCREWLESS CONNECTOR

FIELD OF THE INVENTION

The invention relates to an electrical connector. More specifically, but not exclusively, the invention relates to an electrical connector of the kind used by international travellers to enable the connection of electrical appliances conforming to one standard of plug configuration to electrical outlets or sockets formed to receive plugs conforming to a different standard.

SUMMARY OF THE INVENTION

It is a principal object of the invention to provide an electrical connector which can be made and assembled simply with the minimum of hand labour. It is a particular object of the invention to provide a connector which requires no fixing screws or the like in its assembly.

According to a preferred embodiment of the invention, an electrical connector comprises a hollow electrically insulating body, one end of which carries a set of male electrical connecting members, the body having first and second body parts which together define the body, one of which parts defines the said one end of the body and the other of which parts defines the other end of the body, the said one body part being formed with an opening communicating with the hollow interior of the body, and said other body part being adapted for reception within the opening. A result of this construction is that the forces imposed on the body on inserting or removing the connector from a wall socket or the like do not tend to pull the connector apart as is usual with conventional connectors, e.g. so-called mains plugs since the hand will grasp and apply force to the part of the body carrying the male connecting members. For this reason it is possible to Join the two body parts together without the need for screws. Preferably the arrangement is such that the other body part is wholly received within the opening in the one body part so that the external surface of the other body part is flush with the surface of the portion of the one body part which defines the opening.

The other body part may be formed with a socket array arranged to receive a corresponding set of male electrical connecting members. Preferably the hollow body contains electrical conductors connecting the set of male electrical connecting members carried by the one body part to the socket array, the conductors being trapped between the two body parts whereby the conductors are located in position.

Preferably the two body parts are connected together by integral snap action connectors which may be formed on the other body part to locate in recesses in the one body part. Preferably the two body parts also have members arranged to engage frictionally one with the other to resist disassembly of the body. These frictional coupling members may comprise a spigot on one of the body parts arranged for engagement in a socket in the other body part. The spigot and socket connectors may also be used to locate the electrical conductors in place in the body. Thus the conductors may be pierced with holes in which the spigot and socket connectors are received.

BRIEF DESCRIPTION OF THE DRAWINGS

The invention is diagrammatically illustrated by way of example in the accompanying drawings in which.

DETAILED DESCRIPTION OF THE PREFERRED EMBODIMENTS

Figure 3:
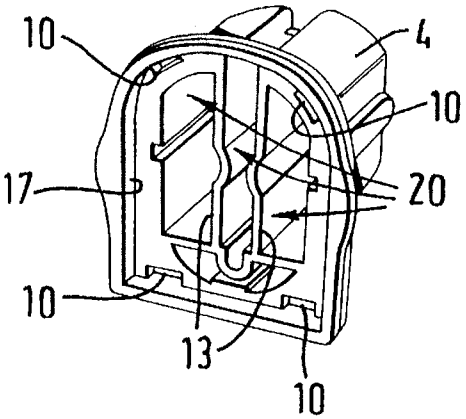
FIG. 3 is a perspective view of the "one" body part and showing its interior.
Figure 5:
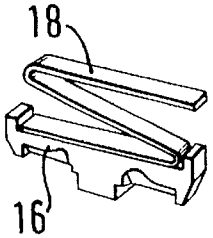
FIG. 5 is a perspective view of a shutter door and spring for use in blanking off the socket array.
Figure 4:
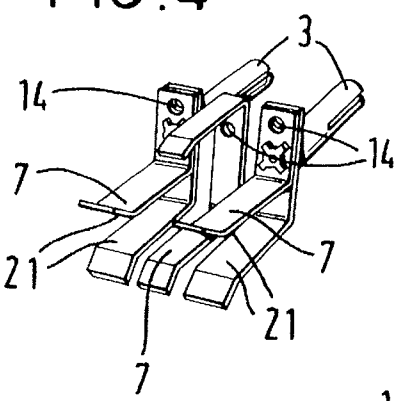
FIG. 4 is a perspective view of a set of internal electrical conductors and attached male and female connecting members to a European standard.
Figure 11:
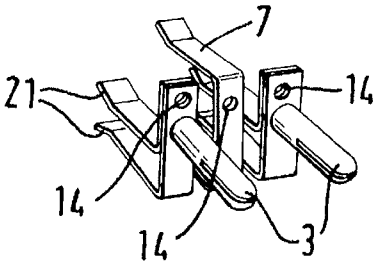
Figure 9:
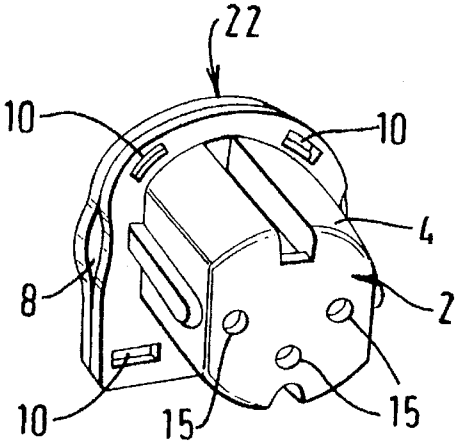
FIG. 9 is a perspective view showing the front of the said "one" body part.
Figure 8:
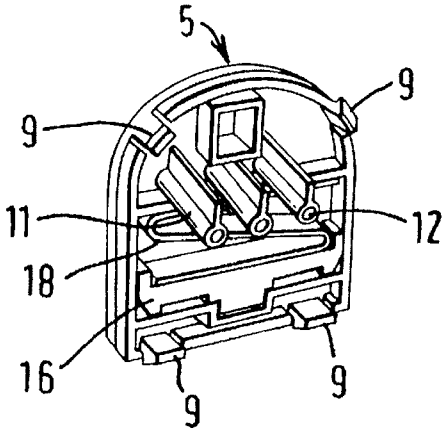
FIG. 8 is a perspective view corresponding to that of FIG. 7 and showing the shutter door mechanism in place.

It will be noted that FIGS. 2 to 5 and 7, 9, 10 and 11 are respective exploded views of the electrical connector taken from diametrically opposed perspectives. In the drawings an electrical connector is shown in the form of a so-called travel adaptor to enable the connection of electrical appliances conforming to one standard of plug configuration to electrical outlets or sockets formed to receive plugs conforming to a different standard. The connector comprises a hollow electrically insulating body 1, e.g. moulded from plastics, one end 2 of which carries a set of male electrical contact members 3 in the form of brass pins. The body i comprises a first hollow body part 4 which defines the said one end 2 of the connector and a second body part 5 which defines the opposite or other end 22 of the connector. The body part 5 is formed with a socket array 6 for receiving the connecting contact pins of an electrical plug (not shown) the arrangement being that the pins 3 conform to one electrical standard whereas the socket array 6 conforms to a different electrical standard. Internally the socket array 6 is provided with female electrical contact members 21 which are connected to the respective members of the set of pins 3 by electrical conductors 7 as shown in FIGS. 4 and 11 and more fully described below.

Figure 1:
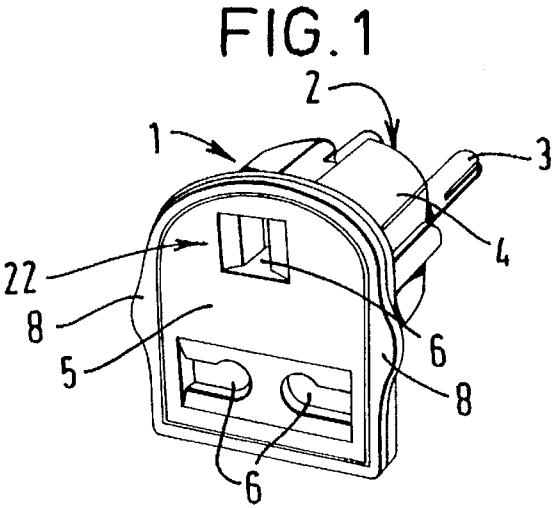
FIG. 1 is a perspective view of an electrical connector taken from said "other" end.
Figure 2:
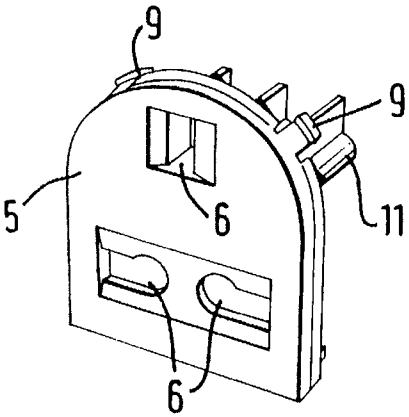
FIG. 2 is a perspective view of the front of the "other" body part.

The body part 4 is formed with a recess 17 which opens into the hollow interior of the body, the recess 17 being arranged snugly to contain the body part 5 so that the external face of the body part 5 lies flush with the surface of the body part 4 defining the recess 17, and closes the hollow interior of the body. Thus when in position as shown in FIG. 1 of the drawings the body part 5 is surrounded by the body part 4 which is formed with an opposed pair of flanges 8 adapted to be grasped by the user when inserting or removing the connector e.g. from a wall socket.

Figure 6:
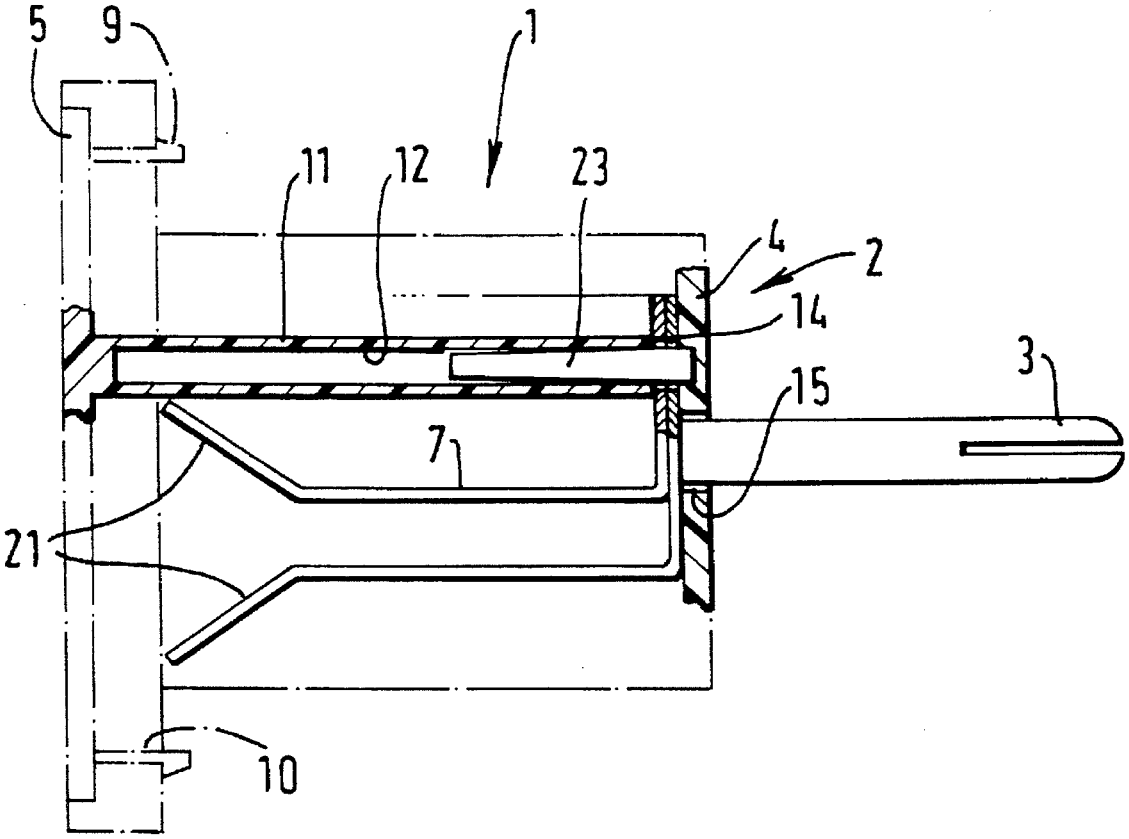
FIG. 6 is a scrap cross-sectional view of a detail of the interior arrangement of the electrical connector of FIGS. 1 to 5.
Figure 7:
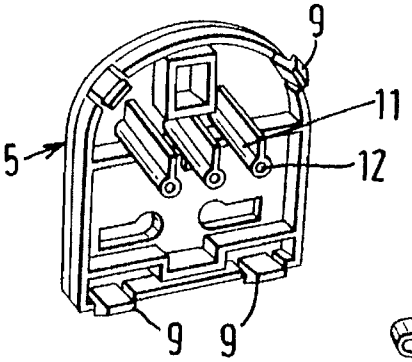
FIG. 7 is a perspective view showing the interior of the "other" body part.
Figure 10:
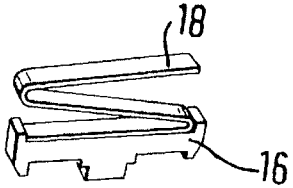
FIGS. 10 and 11 are perspective views corresponding to those of FIGS. 5 and 4 respectively and taken from a diametrically opposite perspective.

The body part 5 is formed with a series of snap-action connectors 9 which are adapted to engage in corresponding recesses 10 in the body part 4 to hold the two body parts together. In addition the body part 5 is formed with three projecting bosses 11 formed with sockets 12 adapted to receive corresponding projecting pins or spigots 23 formed in the interior of the body part 4, see FIG. 6. The spigots and sockets are dimensioned to engage frictionally on assembly of the two body parts to resist subsequent disassembly of the body parts.

The interior of the body part 4 is formed with partitions 13 which divide the interior of the hollow body into three electrically separate chambers 20 to assure electrical isolation between the conductors 7 which are located one in each of the separate chambers, with their associated pins 3 projecting through apertures 15 in the end 2 of the body part 4. The electrical conductors 7 are further located in position by forming them with apertures 14 which are engaged by the pins or spigots 23 in the body part 4 and in addition the bosses 11 are dimensioned to trap the conductors 7 against the body part 4 so that the conductors are located firmly in position, see FIG. 6.

It will be appreciated that although the invention has been specifically described with reference to a so-called travel adaptor it is equally applicable to other electrical connectors such as mains plugs and the like.

I claim:

1. An electrical connector, comprising:

a hollow electrically insulating body having opposed ends;

a set of male electrical contact members projecting from one end of the body;

electrical conductor means disposed within the body and cooperating with the electrical contact members;

first and second body parts which together define the body, one of the body parts defining said one end of the body and a hollow interior thereof, and the other of the body parts defining the other end of the body;

a recess formed in said one body part, which recess communicates with the hollow interior of the body and receives said other body part;

means extending from said other body part into the hollow interior for locating and retaining therein said electrical conductor means associated with the male electrical contact members, and at least one spigot projecting from said one body part, and wherein the extending means includes at least one socket for receiving the at least one spigot.

2. The electrical connector according to claim 1, comprising:

an array of female electrical contacts disposed within the hollow interior; and a socket array provided in said other body part, said female array being accessible through said socket array.

3. The electrical connector according to claim 2, wherein:

the male electrical contact members conform to a first electrical standard configuration, and the female array and socket array conform to a second electrical standard configuration.

4. The electrical connector according to claim 2, wherein:

said electrical conductor means comprises electrical conductor members which connect the male electrical contact members carried by said one body part to corresponding electrical contacts of the female array.

5. The electrical connector according to claim 4, wherein:

the internal formation of said one body part comprises projecting members and said conductor members are provided with apertures corresponding with said projecting members, said apertures of said conductor members fitting respectively over a different corresponding one of said projecting members.

6. The electrical connector according to claim 4, wherein:

said one body part includes means for dividing the hollow interior into electrically separate chambers each containing a respective one of said electrical conductor members.

7. The electrical connector according to claim 4, wherein:

the male electrical contact members and the electrical contacts of the female array are integral with corresponding electrical conductor members.

8. The electrical connector according to claim 1, wherein:

the spigots and sockets interengage frictionally to resist disassembly of the body.

9. The electrical connector according to claim 1, further comprising:

snap action connectors respectively integral with the first and second body parts to connect the same together.

10. The electrical connector according to claim 9, wherein:

said extending means of said other body part and correspondingly shaped and disposed internal portions of said one body part interengage frictionally to resist disassembly of the body.

11. An electrical connector, comprising:

a hollow electrically insulating body having opposed ends;

a set of male electrical contact members projecting from one end of the body;

electrical conductor means disposed within the body and cooperating with the electrical contact members;

first and second body parts which together define the body, one of the body parts defining said one end of the body and a hollow interior thereof, and the other of the body parts defining the other end of the body;

a recess formed in said one body part, which recess communicates with the hollow interior of the body and receives said other body part; and means extending from said other body part into the hollow interior for locating and retaining therein said electrical conductor means associated with the male electrical contact members, wherein said other body part, except for said extending means, is substantially wholly received within the recess in said one body part, and an external surface of said other body part is formed so as to then be flush with a surface of an end portion of said one body part.

12. An electrical connection adaptor, comprising:

a hollow electrically insulating body having opposed ends;

a set of male electrical contact members at one of said opposed ends of the body and conforming to one electrical standard configuration;

a socket array through the other of said opposed ends of the body and conforming to another standard configuration;

first and second body parts which together define the body, one of which parts defines said one end of the body and hollow interior thereof and the other of which body parts defines the other end of the body;

a recess formed in said one body part and in communication with the hollow interior of the body, said other body part being adapted for reception within the recess such that the other body part is substantially wholly received within the recess in the one body part so that an external surface of the other body part is flush with a surface of the portion of the one body part which defines the recess;

a set of female electrical contacts provided in said one body part and accessible through said socket array of said other body part;

a plurality of electrical conductors in the hollow body and integral with the set of male electrical contact members carried by the one body part and with the female electrical contacts;

snap action connectors integral with the first and second body parts to connect the same together;

members on each of the two body parts and disposed in the hollow interior of the body, said members being arranged to interengage frictionally to resist disassembly of the body and to trap the electrical conductors between the members whereby the electrical conductors are located in respective selected positions; and means dividing the hollow interior of the body into electrically separate chambers each containing a respective one of the electrical conductors, the frictionally interengaging members comprising a spigot on one of the first and second body parts arranged for engagement in a socket in the other of the first and second body parts, the electrical conductors being formed with apertures adapted to receive respective spigots to locate the electrical conductors in position.

13. An electrical connector, comprising:

a hollow electrically insulating body having opposed ends;

a set of male electrical contact members projecting from a first end of the body;

electrical conductor means disposed within the body and cooperating with the male electrical contact members;

first and second body parts which together define the body and a hollow interior thereof, one of the body parts defining said first end and a hollow interior of the body and the other of the body parts defining a second end of the body;

a recess formed in said one body part, which recess communicates with the hollow interior of the body and receives said other body part; and means extending from said other body part into the hollow interior for locating and retaining therein said electrical conductor means cooperating with the male electrical contact members;

wherein said other body part, except for said extending means, is substantially wholly received within the recess in said one body part, and an external surface of said other body part is formed so as to be flush with a surface of an end portion of said one body part.

14. An electrical connector, comprising:

a hollow electrically insulating body having opposed ends;

a set of male electrical contact members projecting from a first end of the body;

electrical conductor means disposed within the body and cooperating with the electrical contact members;

first and second body parts which together define the body and a hollow interior thereof, one of which body parts defines said first end of the body and a hollow interior, and the other of the body parts defining a second end of the body;

a recess formed in said one body part, which recess communicates with the hollow interior of the body and receives said other body part;

means extending from said other body part into the hollow interior for locating and retaining therein said electrical conductor means associated with the male electrical contact members; and snap-action connectors respectively integral with the first and second body parts to connect the same together;

wherein said extending means of said other body part and correspondingly shaped and disposed internal portions of said one body part interengage frictionally to resist disassembly of the body.

15. An electrical connector, comprising:

a hollow electrically insulating body having opposed ends;

a set of male electrical contact members provided at one end of the body;

first and second body parts which together define the body and a hollow interior thereof, one of which body parts defines said one end of the body and its hollow interior, and the other of which body parts defines the other end of the body;

a recess formed in said one body part, which recess communicates with the hollow interior of the body and receives said other body part; and members arranged in the hollow interior of said one body part so as to extend from said other body part into the hollow interior, which said members then interengage frictionally to resist disassembly of the body, wherein the frictionally interengaging members comprise at least one spigot for one engagement in a corresponding at least one socket.

16. An electrical connector according to claim 15, further comprising:

snap action connectors integral with the body parts to connect the two body parts together where they interlocate at said recess.

17. An electrical connector, comprising:

a hollow electrically insulating body having opposed ends;

a set of male electrical contact members fixed to project in a single configuration from one end of the body;

electrical conductor means disposed within the body and cooperating with the electrical contact members;

first and second body parts which together define the body, one of the body parts defining said one end of the body and a hollow interior thereof, and the other of the body parts defining the other end of the body;

a recess formed in said one body part, which recess communicates with the hollow interior of the body and receives said other body part;

means extending from said other body part into the hollow interior for locating and retaining therein said electrical conductor means associated with male electrical contact members;

an array of female electrical contacts disposed within the hollow interior; and a socket array provided in said other body part, said female array being accessible through said socket array, wherein the male electrical contact members conform to a first electrical standard configuration, and the female array and socket conform to a second electrical standard configuration different from the first electrical standard configuration.

18. An electrical connector according to claim 17, wherein:

the recess has a shape which corresponds to an external peripheral shape of said other body part.

* * * * *